US006457239B1

(12) United States Patent
McLaughlin

(10) Patent No.: US 6,457,239 B1
(45) Date of Patent: Oct. 1, 2002

(54) MAGNETIC KNIFE SHEATH

(76) Inventor: Kevin William McLaughlin, 1037 Page St., Berkeley, CA (US) 94715

( * ) Notice: Subject to any disclaimer, the term of this patent is extended or adjusted under 35 U.S.C. 154(b) by 0 days.

(21) Appl. No.: 09/732,649

(22) Filed: Dec. 7, 2000

(51) Int. Cl.[7] ..... B26B 3/06
(52) U.S. Cl. ..... 30/151; 30/298.4
(58) Field of Search ..... 30/298.4, 151, 30/153, 296.1, 504, 514; 211/DIG. 1, 70.7; 224/183, 232; 248/309.4; 220/483

(56) References Cited

U.S. PATENT DOCUMENTS 4,183,439 A * 1/1980 Bell ..... 211/70.7
4,492,028 A * 1/1985 Bourgein ..... 30/296.1
4,726,498 A * 2/1988 Esposito ..... 30/151
4,825,545 A * 5/1989 Chase et al. ..... 30/153
4,942,663 A * 7/1990 Ray, Sr. ..... 30/151
5,011,102 A 4/1991 Kiefer ..... 248/37.3
5,211,322 A 5/1993 Nealy ..... 224/232
5,425,160 A * 6/1995 Krapf ..... 24/303
5,490,607 A * 2/1996 Hsieh et al. ..... 220/483
5,682,653 A 11/1997 Berglöf et al. ..... 24/303
6,044,561 A * 4/2000 Baraky et al. ..... 30/153
6,195,898 B1 * 3/2001 Lemisch ..... 30/153

* cited by examiner

*Primary Examiner*—Hwei-Siu Payer
(74) *Attorney, Agent, or Firm*—Adams Law Office; Sharon J. Adams

(57) ABSTRACT

The invention is a magnetic knife sheath that permits easy transport and protection of knives in a relatively small sheath. The sheath has two magnetically charged faces that attract each other, protecting and holding the knife blade securely between them.

8 Claims, 3 Drawing Sheets

MAGNETIC KNIFE SHEATH

FIELD OF INVENTION

This invention relates to magnetic knife sheaths. More specifically, the invention allows for easy transport and protection of knives in a relatively small magnetic sheath. The sheath has two magnetically charged faces that attract each other, protecting and holding the knife blade securely between them.

BACKGROUND OF THE INVENTION

Professional chefs frequently carry their knives from place to place. During transport it is necessary to protect the knife blades, both to keep the blade sharp and to prevent accidentally cutting oneself. In addition, individuals at home frequently use some sort of sheath to protect and secure kitchen knives.

In order to transport their knives, professional chefs typically use a lightweight, hard plastic sheath that holds the knife blade. The plastic sheath is shaped like a long and very narrow taco shell. The bottom side is sealed. The other three sides have very narrow slots. The knife blade must be forced into the narrow slot, between the plastic faces. The knife blade is held in place simply by the narrowness and tightness of the plastic slot.

The plastic sheath has several disadvantages. A knife blade is not immobilized between the plastic faces. The knife blade can move against the bottom of the plastic sheath, dulling the knife blade.

In addition, the plastic sheaths are solid and inflexible. They cannot be opened. Therefore, the plastic sheaths cannot be cleaned or sterilized. Chefs are often tired at the end of a long night of work, and frequently place their knives into the plastic sheaths without thoroughly cleaning the knife blade first. Because the plastic sheaths cannot be opened or cleaned, particles of food from the dirty knife blade may remain inside the plastic sheath. The invention makes it possible to open and clean the knife sheath.

Furthermore, because the plastic sheath cannot be opened, chefs may cut their hands when placing the knife blade into the plastic sheath. Placing the knife blade in the plastic sheath involves holding the plastic sheath in one hand and the knife in the other. The chef then lines up the knife blade with the very narrow slot in the plastic sheath, and pushes the knife blade into the plastic sheath. If the chef misaligns the knife blade and the slot in the plastic sheath, the knife blade may be pushed into the palm of the hand that is holding the plastic sheath. The knives are very sharp and will frequently cut the chef's hand. It is much easier and safer to place a knife blade into the invention because the invention may be opened.

Individuals at home also wish to protect and secure their knifes. The magnetic knife holders most commonly used in the home involve a large magnet, which is attached to a wall or cabinet. Alternatively, knives are frequently placed in some sort of wooden block, or some other solid material that holds the knives as a group on a countertop. These various types of knife holders take up a lot of space on a wall or cabinet. In addition, they are difficult to clean. None of the prior inventions provide a lightweight, compact means for securing and protecting knife blades.

BRIEF SUMMARY OF THE INVENTION

The present invention involves a devise for securing knives comprising two magnetically charged faces movably attached to each other by a magnet support with a central hinge, wherein, when in the closed position, the magnetically charged faces cover all, or a part of, the knife blade, thereby securing and protecting the knife blade

OBJECTS AND ADVANTAGES

Several of the objects and advantages of the present invention are described below.

One object of the invention is to provide an inexpensive, lightweight, small and moveable means for securing and protecting knife blades.

It is a further object to immobilize knife blades during transport and storage to prevent dulling the knife blade.

It is still a further object to allow the knife sheath to be cleaned and sterilized.

It is still a further object to permit the knife sheath to be opened and closed.

It is still a further object to prevent or reduce accidents by making it easier to place the knife into the sheath.

Further objects and advantages will become apparent from a consideration of the ensuing description and drawings.

DETAILED DESCRIPTION OF THE INVENTION

Figure 1:
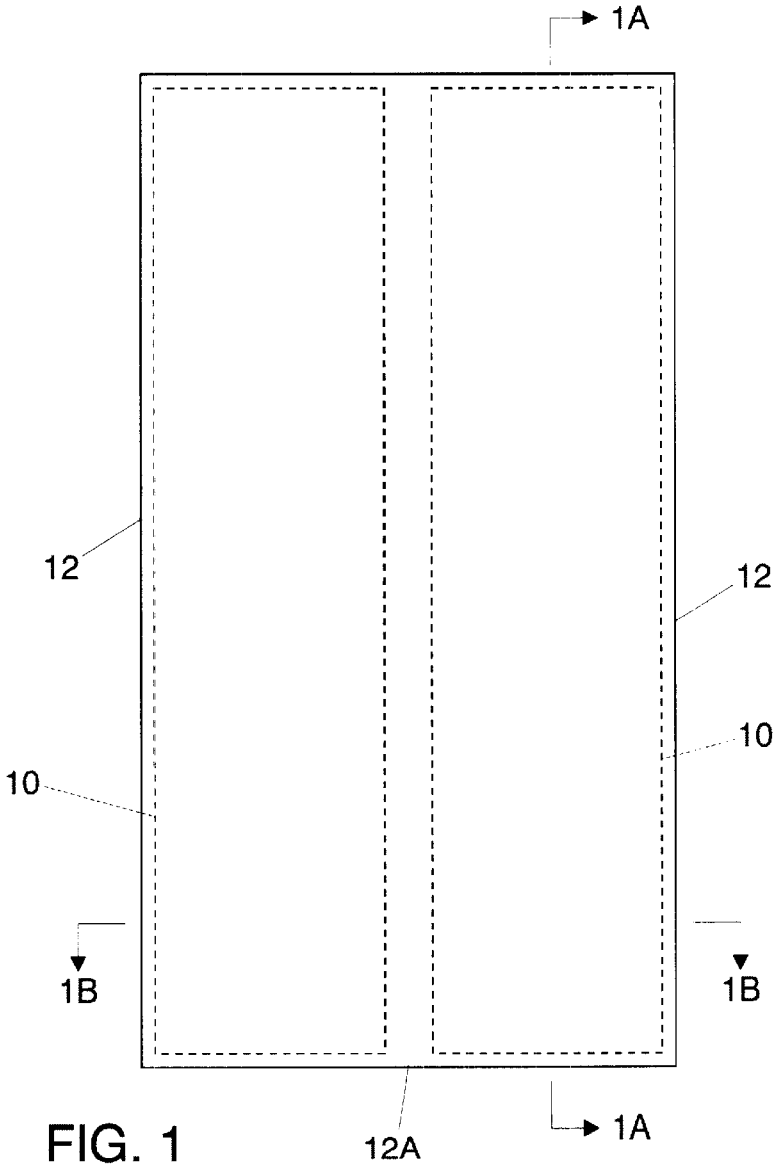
FIGS. 1, 1A and 1B show the invention in the open position, looking down from directly above, and also show end-on sectional views of the invention.
Figure 1A:
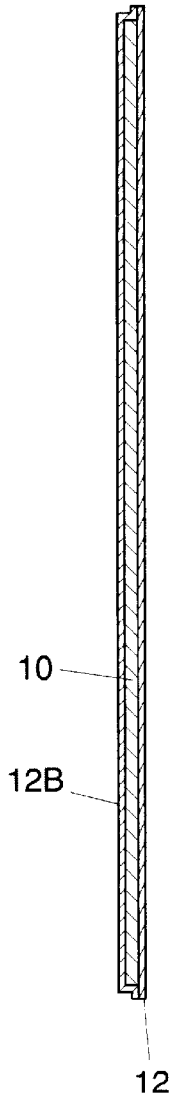
Figure 1B:
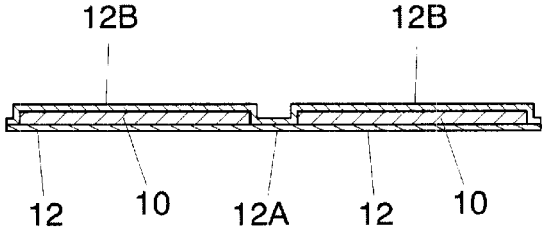
Figure 3:
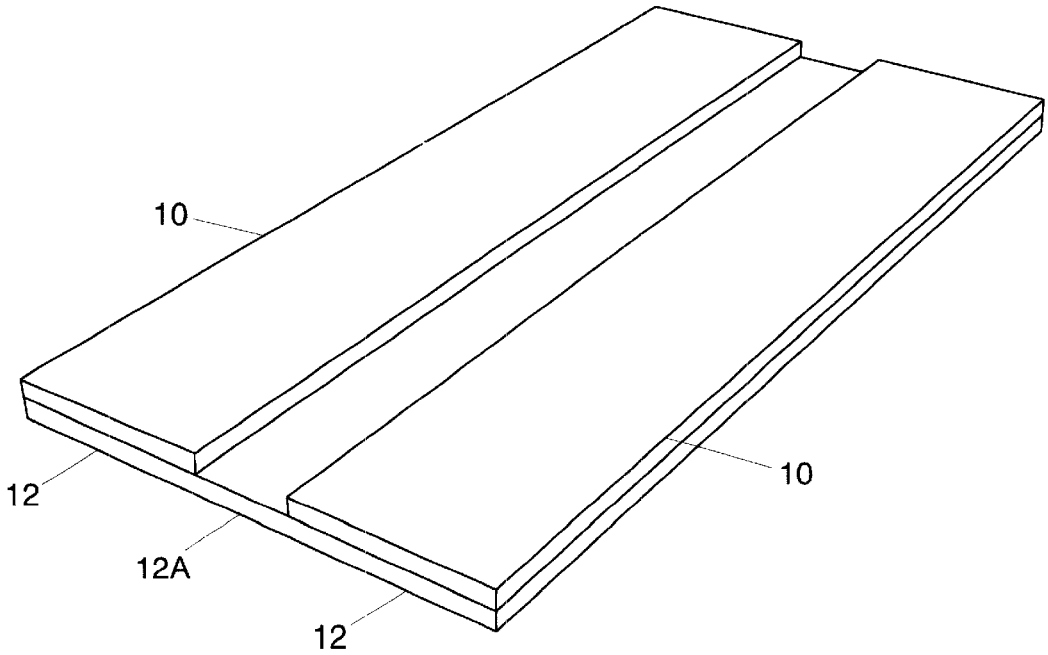
FIG. 3 is a perspective view of the invention in the open position.

Referring to the drawings, there are two magnetically charged faces 10. The magnetically charged faces 10 are preferably made from lightweight magnets. Each magnet 10 is either secured between magnet support 12 and interior face 12B (as shown in FIG. 1), or attached directly to a magnet support 12 without an interior face 12B (as shown in FIG. 3). The inventor currently prefers making the magnet support 12 and interior face 12B from flexible vinyl. However, the magnet support 12 and interior face 12B may also be made of a wide variety of materials that may be repeatedly bent without breaking, for example, high-density polymers, rubber, or leather. In the preferred embodiment, the magnet support 12 will have a design printed directly on the flexible vinyl, high-density polymer, rubber, leather or other flexible material. Alternatively, the magnet support 12 may have no design, or may have a design that is laminated to the exterior surface of the magnet support.

The magnetically charged face 10 is placed adjacent to magnet support 12. FIG. 1 shows that two magnetically charged faces 10 are sealed between magnet support 12 and interior face 12B. Magnet support 12 and interior face 12B are preferably made out of the same material. In the embodiment shown in FIG. 1, each magnetically charged face 10 is sealed on all four sides between magnet support 12 and interior face 12B. The seal between magnet support 12 and interior face 12B is preferable created through the application of heat, but the seal may also be created by adhesive or sealant. The seal should be susceptible to washing and sterilizing, thus permitting the entire invention to be cleaned and sterilized.

In another embodiment, shown in FIG. 3, the invention does not contain an interior face 12B. Instead, each magnetically charged face 10 adheres to magnet support 12 by virtue of either the application of adhesive, such as urethane, acrylic, epoxy glue, or other adhesive, or the application of heat to form a thermal bond. The adhesive or thermal bonding should be susceptible to washing and sterilizing, thus permitting the entire invention to be cleaned and sterilized.

Figure 2:
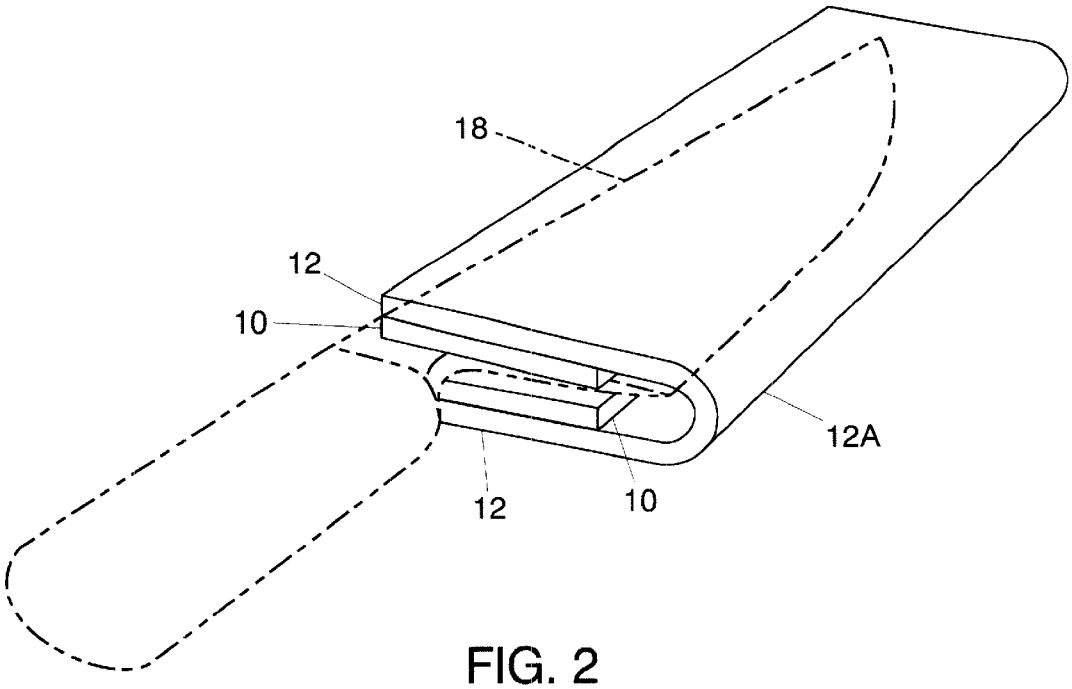
FIG. 2 is a perspective view of the invention in the closed position with a knife blade, drawn in phantom outline, secured between the magnetically charged faces.

In the embodiments shown by FIG. 1 and FIG. 3, the two magnetically charged faces are placed in such a manner that when the invention is in the closed position, as shown in FIG. 2, the magnetically charged faces 10 are magnetically attracted to each other. The magnetic attraction of the magnetically charged faces will securely hold the knife blade, as shown in FIG. 2.

Figure 4:
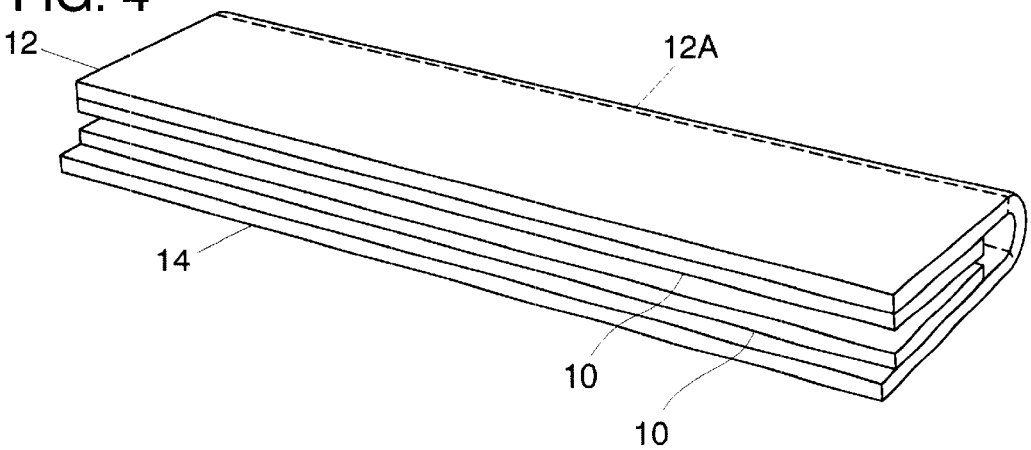
FIGS. 4, 4A and 4B are perspective views of the invention in the closed position showing differently sized tabs on the magnet supports to facilitate opening the invention.
Figure 4A:
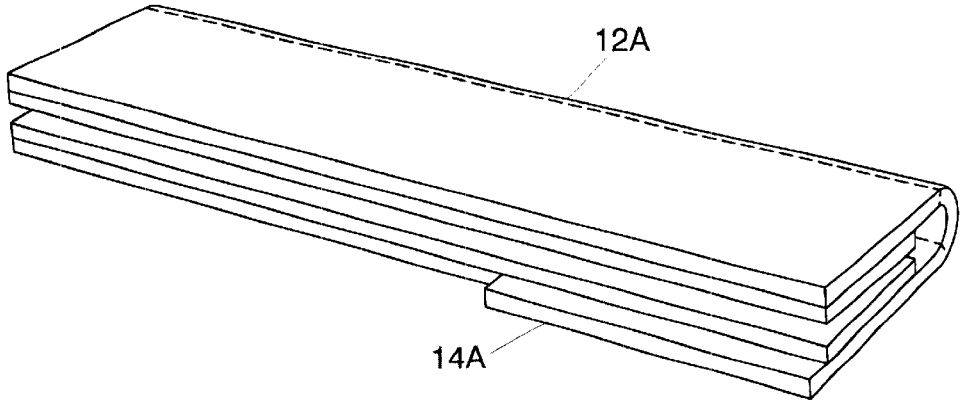
Figure 4B:
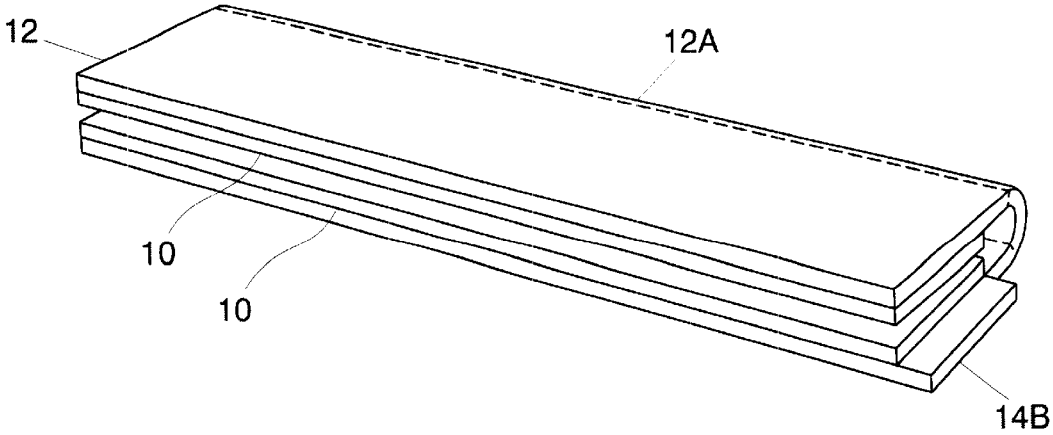

The invention contains a flexible portion, living hinge, or central hinge 12A located between the magnetically charged faces 10. FIG. 4, FIG. 4A and FIG. 4B indicate the location of the central hinge by dashed lines. The central hinge 12A is sufficiently flexible to allow hinge-like motion so that the invention may be repeatedly opened and closed. FIG. 1 and FIG. 3 show the invention in the open position. The central hinge 12A allows the magnet support 12 to move from the open position to the closed position shown in FIG. 2.

When in the closed position, one magnetically charged face 10 lines up with the other magnetically charged face 10; that is, the magnetically charged faces 10 are essentially opposite to each other, and form a mirror image of each other. The magnetically charged faces 10 are aligned on the magnet support 12 so that when central hinge 12A is in the closed position (see FIG. 2) the magnetic poles of magnetically charged faces 10 are magnetically attracted to each other. This magnetic attraction causes the central hinge 12A to remain in the closed position, thereby holding and securing the knife blade 18 in place. The inventor currently prefers to make the central hinge 12A out of the same material used for the magnet support 12, with the same cross-sectional thickness. Alternatively, the central hinge 12A may be a living hinge, or may be made by scoring, or by a mechanical hinge.

The size and shape of the magnetically charged faces 10, the magnet support 12 and the interior face 12B can be varied as needed to match the different sizes of different knife blades. Typically, the entire knife blade will be completely covered by the magnetically charged faces 10, the magnet support 12, or the interior face 12B. However, it is not absolutely necessary to have the entire knife blade covered by the magnetically charged faces 10, the magnet support 12, or the interior face 12B. Some knife blades, for example, large or curved knife blades, may be secured and protected by the invention as long as the sharp edge of the blade is covered by the magnetically charged faces 10, the magnet support 12, or the interior face 12B.

FIGS. 4, 4A and 4B shows additional embodiments of the invention. FIG. 4 shows an embodiment in which one edge of the magnet support 12 extends beyond the other edge of the magnet support 12 to form a tab 14. The size and shape of tab 14 can be varied. For example, tab 14 may extend the entire length of magnet support 12, as shown in FIG. 4. Alternatively, the tab 14 may be shorter than the length of magnet support 12 to form a tab 14A, as shown in FIG. 4A. Another alternative is to place the tab 14B along the short edge of magnet support 12, as shown in FIG. 4B.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A device for securing knives in combination with a knife, the device comprising two magnetically charged faces, each magnetically charged face made of a magnet, and each magnetically charged face moveably attached to the other magnetically charged face by a magnet support with a central hinge, wherein, when in the closed position, the magnetically charged faces cover all, or a part of, a knife blade, thereby securing and protecting the knife blade.

2. A device for securing knives in combination with a knife according to claim 1 wherein the magnetically charged faces are entirely sealed between the magnet support and an interior face.

3. A device for securing knives in combination with a knife according to claim 1 or 2 wherein the magnetically charged faces are made from the group consisting of lightweight or flexible magnets.

4. A device for securing knives in combination with a knife according to claim 1 or 2 wherein the magnet support is comprised of flexible vinyl, plastic or others flexible material.

5. A device for securing knives in combination with a knife according to claim 2 wherein the interior face is comprised of flexible vinyl, plastic or other flexible material.

6. A device for securing knives in combination with a knife according to claim 1 or 2 wherein the magnet support extends further beyond one magnetically charged face than the other magnetically charged face, to facilitate opening.

7. A device for securing knives in combination with a knife according to claim 1 or 2 wherein the magnet support and the central hinge are comprised of a single piece of flexible vinyl, plastic or other flexible material.

8. A device for securing knives in combination with a knife according to claim 1 or 2 wherein all materials used in the device are capable of being cleaned, sanitized or sterilized.

* * * * *

US006457239C1

(12) EX PARTE REEXAMINATION CERTIFICATE (6048th)

United States Patent
McLaughlin

(10) Number: US 6,457,239 C1
(45) Certificate Issued: Dec. 11, 2007

(54) MAGNETIC KNIFE SHEATH

(76) Inventor: Kevin William McLaughlin, 1037 Page St., Berkeley, CA (US) 94715

Reexamination Request:
No. 90/006,825, Oct. 24, 2003

Reexamination Certificate for:

| | |
|---|---|
| Patent No.: | **6,457,239** |
| Issued: | **Oct. 1, 2002** |
| Appl. No.: | **09/732,649** |
| Filed: | **Dec. 7, 2000** |

(51) Int. Cl.

| | |
|---|---|
| ***B26B 3/06*** | (2006.01) |
| ***B26B 29/02*** | (2006.01) |
| ***B26B 29/00*** | (2006.01) |

(52) U.S. Cl. ..... 30/151; 30/298.4

(58) Field of Classification Search ..... 30/151, 30/153, 298.4, 196.1, 504; 211/DIG. 1, 70.7; 224/183, 232; 248/309.4; 220/483
See application file for complete search history.

(56) References Cited

U.S. PATENT DOCUMENTS

| | | | | |
|---|---|---|---|---|
| 3,008,617 | A | 11/1961 | Villwock | 224/2 |
| 3,727,658 | A | 4/1973 | Eldridge, Jr. | 150/52 R |
| 5,538,132 | A | 7/1996 | Propp et al. | 206/365 |

FOREIGN PATENT DOCUMENTS

| | | |
|---|---|---|
| SE | 453620 | 2/1988 |

*Primary Examiner*—Kenneth E. Peterson

(57) ABSTRACT

The invention is a magnetic knife sheath that permits easy transport and protection of knives in a relatively small sheath. The sheath has two magnetically charged faces that attract each other, protecting and holding the knife blade securely between them.

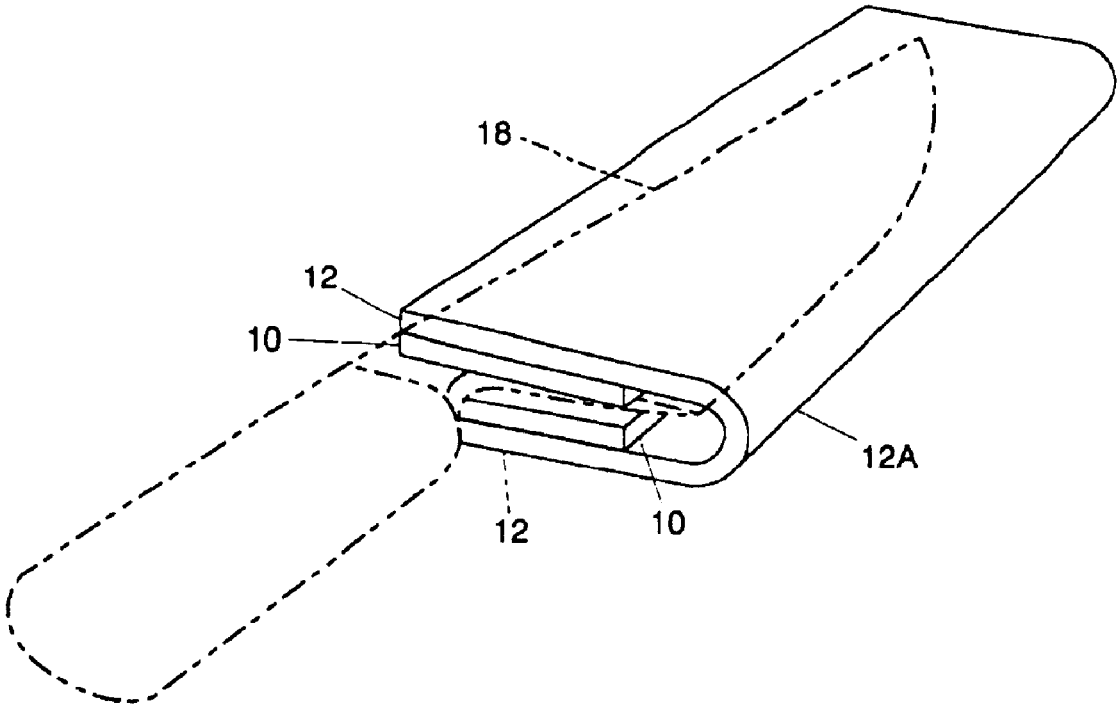

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 42–58:

Referring to the drawings, there are two magnetically charged faces 10. The magnetically charged faces 10 are preferably made from lightweight *or flexible* magnets. Each magnet 10 is either secured between magnet support 12 and interior face 12B (as shown in FIG. 1), or attached directly to a magnet support 12 without an interior face 12B (as shown in FIG. 3). The inventor currently prefers making the magnet support 12 and interior face 12B from flexible vinyl. However, the magnet support 12 and interior face 12B may also be made of a wide variety of materials that may be repeatedly bent without breaking, for example, high-density polymers, rubber, or leather. In the preferred embodiment, the magnet support 12 will have a design printed directly on the flexible vinyl, high-density polymer, rubber, leather or other flexible material. Alternatively, the magnet support 12 may have no design, or may have a design that is laminated to the exterior surface of the magnet support.

AS A RESULT OF REEXAMINATION, IT HAS BEEN DETERMINED THAT:

Claims 1–8 are cancelled.

* * * * *